United States Patent [19]

Strohmeyer, Jr.

[11] Patent Number: 4,462,341

[45] Date of Patent: Jul. 31, 1984

[54] CIRCULATING FLUIDIZED BED COMBUSTION SYSTEM FOR A STEAM GENERATOR WITH PROVISION FOR STAGED FIRING

[76] Inventor: Charles Strohmeyer, Jr., 1617 Sweetbriar Rd., Gladwyne, Pa. 19035

[21] Appl. No.: 473,651

[22] Filed: Mar. 9, 1983

Related U.S. Application Data

[63] Continuation-in-part of Ser. No. 456,586, Jan. 7, 1983, Pat. No. 4,442,796.

[51] Int. Cl.[3] ..... F22B 1/00

[52] U.S. Cl. ..... 122/4 D; 110/263; 431/170

[58] Field of Search ..... 122/4 D, 479 B; 110/245, 263; 431/7, 170; 165/104.16; 34/57 A

[56] References Cited

U.S. PATENT DOCUMENTS 3,171,390 3/1965 Blodgett ..... 122/479 B
4,184,455 1/1980 Talmud et al. ..... 122/4 D
4,335,683 6/1982 Criswell et al. ..... 110/245
4,397,267 8/1983 Fink ..... 122/4 D

FOREIGN PATENT DOCUMENTS 56-68708 6/1981 Japan ..... 431/7

*Primary Examiner*—Edward G. Favors
*Assistant Examiner*—Steven E. Warner
*Attorney, Agent, or Firm*—William J. Ruano

[57] ABSTRACT

The invention comprises a steam generator having a circulating fluidized bed combustion system whereby there is provision to admit air flow incrementally along the gas path to control combustion rate and firing temperature in a manner to maintain differential temperatures along the gas path. The initial portion of the gas path where combustion is initiated can be held in one temperature range as 1550° F. which is optimum for sulphur retention and the final portion of the combustion zone can be elevated in temperature as to 1800° F. to produce a greater degree of heat transfer through the gas to fluid heat exchange surface downstream of the combustion zone.

2 Claims, 2 Drawing Figures

CIRCULATING FLUIDIZED BED COMBUSTION SYSTEM FOR A STEAM GENERATOR WITH PROVISION FOR STAGED FIRING

This invention is a continuation-in-part of U.S. patent application Ser. No. 6/456,586 filed 01/07/83 now U.S. Pat. No. 4,442,796.

This invention relates to means for improving the performance of steam generators having fluidized bed combustors.

Past fluidized bed combustors have been limited in size due to the large cross section area required to admit the required amount of air to the bed. Air flow quantity is a function of the velocity of the air flow through the bed. In a bubbling bed the air velocity is limited to about 8 feet per second without lifting the bed up into the furnace. Air/gas velocity in a conventional pulverized coal fired furnace ranges between 20 and 30 feet per second. Therefore, the furnace cross section for a given load is much larger for the bubbling fluidized bed.

In the case of a circulating fluidized bed, the furnace air/gas velocity approaches that for a conventional furnace. There can be an equivalency with respect to furnace cross-section areas.

In order to maximize $SO_2$ capture when sulphur bearing coal is fired in association with limestone, it is desirable to maintain the fluidized bed temperature in a range of 1550 F. Gas temperature in the 1550 F. range at the exit of the combustion zone is low by comparison to conventional practice and there is limited heat transfer which can take place without further heating of the gas stream. This invention contemplates holding the air/gas temperature in the initial ignition and burnup zone at the 1550 F. level through limiting air flow below the level required for complete fuel burnup adding a residual amount of air at the tail end of the combustion zone to sustain and accelerate combustion thereby raising the gas temperature to 1800 F. at the end of the combustion zone.

The above procedure permits maximum $SO_2$ retention at the head end of the ignition zone and during initial burnup. The burnup rate of low volatile fuels is lengthy in comparison to high volatile fuels. Oxygen consumption is a function of degree of fuel burnup. Thus, sufficient oxygen will be available for reaction with the limestone to capture sulphur as the combustion reaction progresses up through the furnace. Air flow to the initial portion of the combustion zone at high unit loading is inadaquate for complete burnup of the fuel. As the unburned fuel in a state of ignition reaches the end of the combustion zone, an additional shot of air accelerates combustion so it can progress to a final state raising gas temperature at the outlet end of the combustion zone to a level as 1800 F. Some slight sacrifice of $SO_2$ retention may be experienced. The increased efficiency of heat transfer justifies such loss if any.

The end of the combustion zone contains the smaller fuel particles in a state of ignition which react readily with the added air supply for completion of the burnup process.

Differential temperatures are controlled by quantity of air admitted to the respective furnace zones. Gas quantity, or mass flow, can be controlled independently of air flow. Exhaust gas, as from the economizer outlet, is recirculated with the air introduced at the head end or intermediate portion of the combustion zone. This assures that entrainment gas velocity is maintained in all portions of the circulating fluidized bed.

For the steam generator described herein, a specific object of this invention is to provide a staged firing system for a circulating fluidized bed combustion system whereby gas temperature leaving the combustion zone can be elevated above the temperature level at an intermediate portion of the combustion zone.

A further object is to restrict air flow required for fuel burnup at the head end of the combustion zone so that there is unburned fuel available at the tail end portion of the combustion zone, particularly at high unit loadings.

A still further object is to admit air at the outlet end of the combustion zone at times of high unit loading when there is a surplus of fuel in the gas stream to accelerate combustion and completion of fuel burnup at the outlet end of the combustion zone.

A still further object is to recirculate spent hot gas, as from the economizer outlet, through the intermediate portion of the combustion zone along with the air flow, to control gas mass flow through the intermediate zone independently of the availability of oxygen and in a manner to assure solid particle entrainment gas velocity through the intermediate zone.

The invention will be described in detail with reference to the accompanying drawings wherein.

Figure 1:
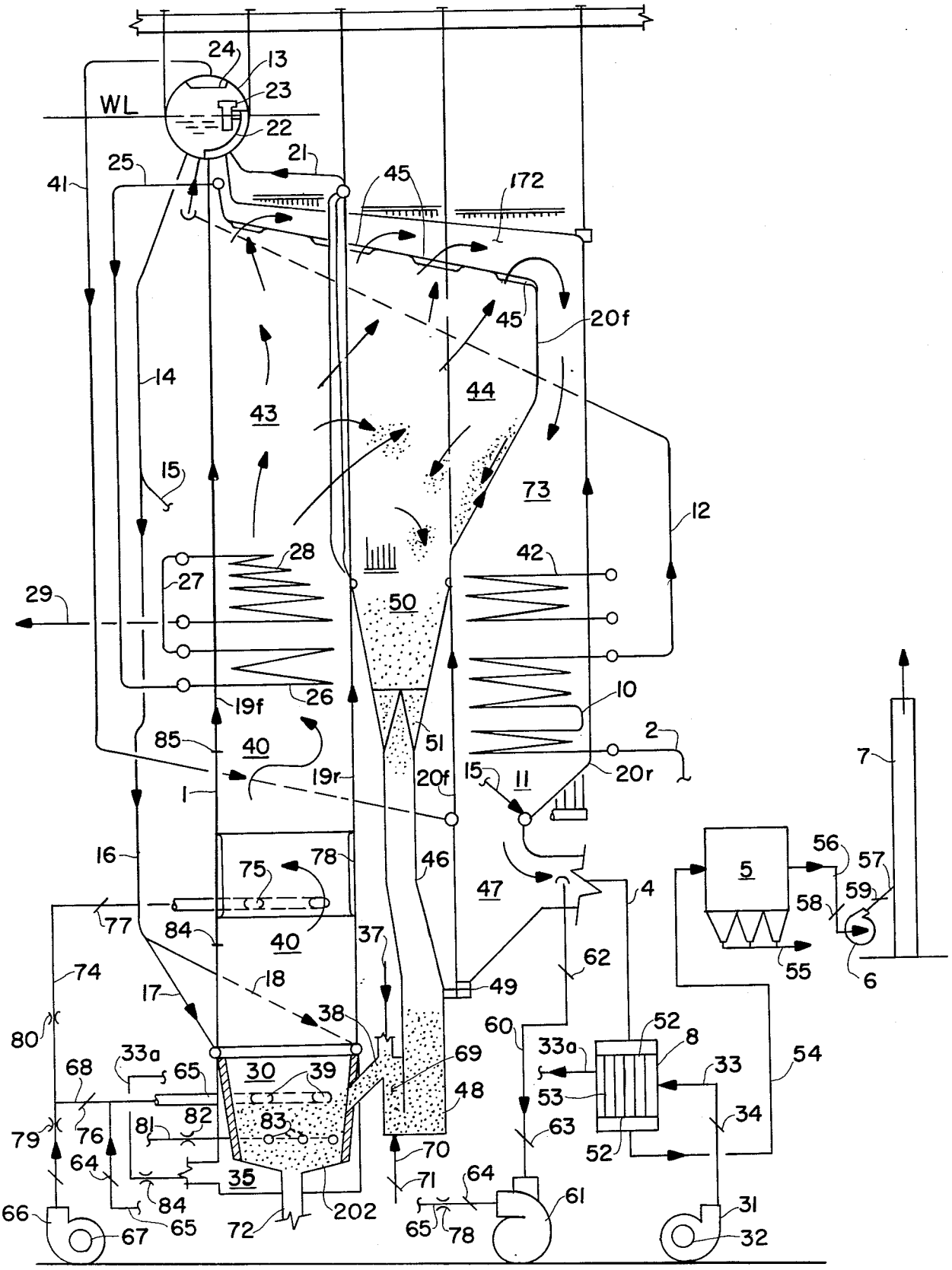
FIG. 1 is a schematic diagram of a steam generator having a circulating type fluidized bed and a staged firing system in accordance with the objectives of the invention.

On FIG. 1, steam generator 1 is of a conventional design with regard to the fluid circuits. Feedwater at the working pressure enters the unit through conduit 2 which feeds to economizer 10.

Effluent from economizer 10 passes through conduit 12 to drum 13 from whence it passes through conduits 14, 15, 16, 17 and 18 to lower waterwall headers which supply the furnace and convection pass waterwalls **19*f*, 19*r* and 20*r*. The waterwalls, including sidewalls, are of the membrane type. Waterwalls 19*f* and 20*r* discharge to drum 13. The rear furnace wall 19*r* is connected to drum 13 through conduit 21**.

Baffle 22 within drum 13 directs the steam and water mixture to separators 23. Separated water exits from the bottom of separator 23 and joins with the feedwater from conduit 12 and is recirculated downward through conduit 14. Separated steam passes through the top of separators 23 through baffles and up through outlet screens 24 to conduit 41.

Steam from drum 13 is drawn through conduit 41 to the inlet header for wall **20*f*. Steam flows up through the tubes and cools the wall and ceiling 20*f*. Steam exits through conduit 25 and passes to primary superheater 26 and through conduit 27 to secondary superheater 28 from whence it flows out through conduit 29** to a steam consumer (not shown).

Water level WL in drum 13 is maintained at a fixed set point by control of feedwater flow through conduit 2 (not shown).

Combustor 30 is of the fluidized type wherein particles of fuel and inert material disperse themselves throughout the bed.

F.D. fan 31 takes air from atmosphere through inlet vanes 32 which control air flow. F.D. fan 31 discharges through duct 33 and shutoff damper 34 (for isolation purposes) to air heater 8. The hot gas then passes through duct 33*a* to plenum chamber 35.

Plenum chamber 35 feeds air to combustor 30 through sized holes in the floor 202 of combustor 30.

Primary fuels, as coal, are fed to combustor 30 through conduit 37. Where $SO_2$ removal is required, limestone is injected with the fuel through conduit 37. Secondary fuels as trash and waste products may enter combustor 30 along with the primary fuel through conduit 37 and 38.

Ignition begins in the lower portion of combustion 30 and as the particles of fuel and inert material rise in the fluidized bed through displacement by fuel, limestone and inert material which are added through conduit 38, reach the level at which ports 39 are located. Ports 39 supply secondary gas flow which generates gas velocity at this point which is sufficiently high to entrain desired quantities of bed solids in the gas stream, carrying such solids upward into furnace 40.

Supplemental air fan 66 takes air from atmosphere through inlet vanes 67 and discharges through duct 68 to duct 65 and ports 39 or alternatively to duct 74 to ports 75. Ports 75 supply tertiary air to the upper portion of furnace 40 for elevating gas temperature at the outlet of furnace 40 as discussed below.

Gas from plenum 11 is drawn through conduit 60 to gas recirculation fan 61. Dampers 62 and 64 are for isolation purposes. Damper 63 is for flow control. Gas recirculation fan 61 discharges through duct 65 to secondary gas ports 39.

Dampers 76 and 77 proportion supplemental air flow to secondary gas ports 39 or tertiary air ports 75 respectively. Inlet vanes 67 control supplemental air flow.

The furnace walls in the vicinity of the tertiary air ports 75 may be studded and lined with refractory 78 to accelerate combustion in the area of refractory 78 and assist in the elevation of gas temperature at the outlet of furnace 40.

According to the present invention, at rated load of the unit, it is desired to raise the level of the furnace 40 gas outlet temperature to a level as 1800° F. to increase heat transfer in the downstream surface 26, 28, 42 and 10 while maintaining gas temperature in the combustor 30 and adjacent area at a level as 1550° F.

Fuel is added to combustor 30 through conduit 38 and at this point it is mixed thoroughly throughout the bed by means of tangential injection of air flow or other turbulant pattern.

Air is admitted to the combustor through sized holes in the floor 202 from plenum 35. This flow is only a portion of the total air flow required for combustion purposes. Additional air flow is added through secondary ports 39. Such air flow would satisfy total air flow requirements at partial load. Additional air flow is required to satisfy full load combustion requirements. Supplemental air for this purpose is added through ports 75.

Air flow through the various points of entry (202, 39 and 75) regulates combustion rates in the associated furnace zones and can be used for control of bed temperatures in these zones.

To accomodate variations in air flow between ports 39 and 75 and to insure adaquate entrainment velocities above ports 39, gas is recirculated from plenum 11 through fan 61 to conduit 65 and through ports 39 to combustor 30. Damper 63 regulates recirculated gas flow.

Gas discharge from gas recirculation fan 61 is metered in venturi 78 and associated measurement means. Primary air flow from F.D. fan 31 is metered in venturi 84 and associated measurement means. Supplemental air flow from fan 66 is metered at the outlet of fan 66 in venturi 79 and associated measurement means. The distribution of fan 66 air flow between ducts 68 and 74 is as follows: Duct 74 flow is metered in venturi 80 and associated measurement means. Duct 68 flow is determined by deducting venturi 80 flow from venturi 79 flow. Gas temperature above ports 39 is measured by thermocouple 84 and temperature above ports 75 is measure by thermocouple 85. After the unit characteristics have been determined, gas temperature measurements can be determined from measurement of lower temperature levels as in the furnace 40 wall membranes, wherein the lower temperatures are a function of the actual gas temperature. This will assure long life of the measurement sensor.

There is a gas velocity increase after the gas enters surface 26 and 28 in series as it leaves furnace 40. As heat is transferred from the gas to the surface 26 and 28 tubes, gas temperature decreases. This reduces the specific volume of the gas as well as gas velocity for a given cross-sectional area.

The volumetric relationship within plenums 43 and 44 is such to permit the gas velocity to drop below entrainment level at the outlet of platens 28 to permit settlement of the fuel and inert material particles which fall downward into hopper 50. Particles collected in hopper 50 drop through transition piece 51 to conduit 46 and storage bin 48.

Gas passes from plenum 43 to plenum 44 through rear furnace wall tubes 19*r* at which point the membrane is lacking and alternating tubes have been spread sufficiently to permit passage of gas.

The tube configuration of surface 28 is such to assist in distribution of gas flow to plenums 43 and 44.

Gas flows upward to the top of plenums 43 and 44 where it exits through ports 45.

Ports 45 are located in the roof plane 20*f* and are formed by upsetting individual tubes for specific lengths from the plane of the tube and membrane sheet. Where the welded-in membranes are of sufficient width, slots 45 can be formed by the omission of the membranes in specified locations.

Ports 45 are spaced and sized to create uniform gas distribution up through plenums 43 and 44. The overall configuration is such to avoid turbulance in the gas flow as it passes from tube bank 28 through plenums 43 and 44 to ports 45.

Duct 72 is formed by the continuation of walls 20*f* and 20*r*, with a space between, over plenums 43 and 44. The walls 20*f* and 20*r* are of the membrane type wherein metal strips are welded in place between parallel tube circuits to make a gas tight enclosure.

Gas from plenum 73 flows through surfaces 42 and 10 to plenum 11. Surface 42 can be reheating surface or an extension of or an alternative for superheating or economizer surface.

Solid particles collected in plenum 11 fall to hopper 47. Rotary feeder 49 is power driven and feeds dust from hopper 47 to bin 48 and is provided with a displacement type of seal to prevent reverse flow.

Gas from plenum 11 passes through duct 4 to air heater 8.

Air heater 8 is provided with tube sheets 52 in which tubes 53 are mounted. The gas from duct 4 passes through tubes 53 to duct 54. F.D. fan 31 discharge air flow passes around tubes 53. Gas duct 54 passes to bag house 5 where dust collection is completed. Dust separated in the bags is removed through conduits 55.

Bag house 5 discharges through duct 56 to I.D. fan 6 and duct 57 to stack 7 and from thence to atmosphere. Dampers 58 and 59 are for isolation purposes and to regulate flow of gas so as to maintain a slightly negative pressure in furnace 40.

Solid particles collected in bin 48 pass through loop seal 69. Dust flow through loop seal 69 is facilitated by means of an air lift. Air under pressure enters through conduit 70 and flow is controlled by regulation means 71 which is power operated.

The recirculation loop of the circulating fluidized bed combustion system can be described as follows: The combustor 30 contains a bubbling bed below ports 39. The lower bed overflows above the secondary gas ports 39 by addition of fuel, limestone and recirculated solid particles through conduit 38. Gas flow through secondary gas ports 39 lifts the bed materials up into furnace 40 as a result of gas velocity in the entrainment range. Solid particles are collected in hopper 50 since gas velocities in plenums 43 and 44 drop below entrainment values. Hopper 50 material drops through piece 51 and conduit 46 to bin 48. From bin 48 solid particles pass through loop seal and air lift 69 to conduit 38 and back to combustor 30 for recycle.

Ash can be removed from the circulating loop through the opening at the bottom of combustor 30 through conduit 72 which is water cooled (not shown). Ash is removed on a continuous basis to maintain equilibrium in the combustion system.

Oil and gas can be admitted through conduit 81, flow control means 82 and nozzles 83 into combustor 30 for firing during unit startup or for use as a supplemental or emergency fuel during times when the design fuel supply has been interrupted. Nozzles 83 are equpped with ignition means.

Figure 2:
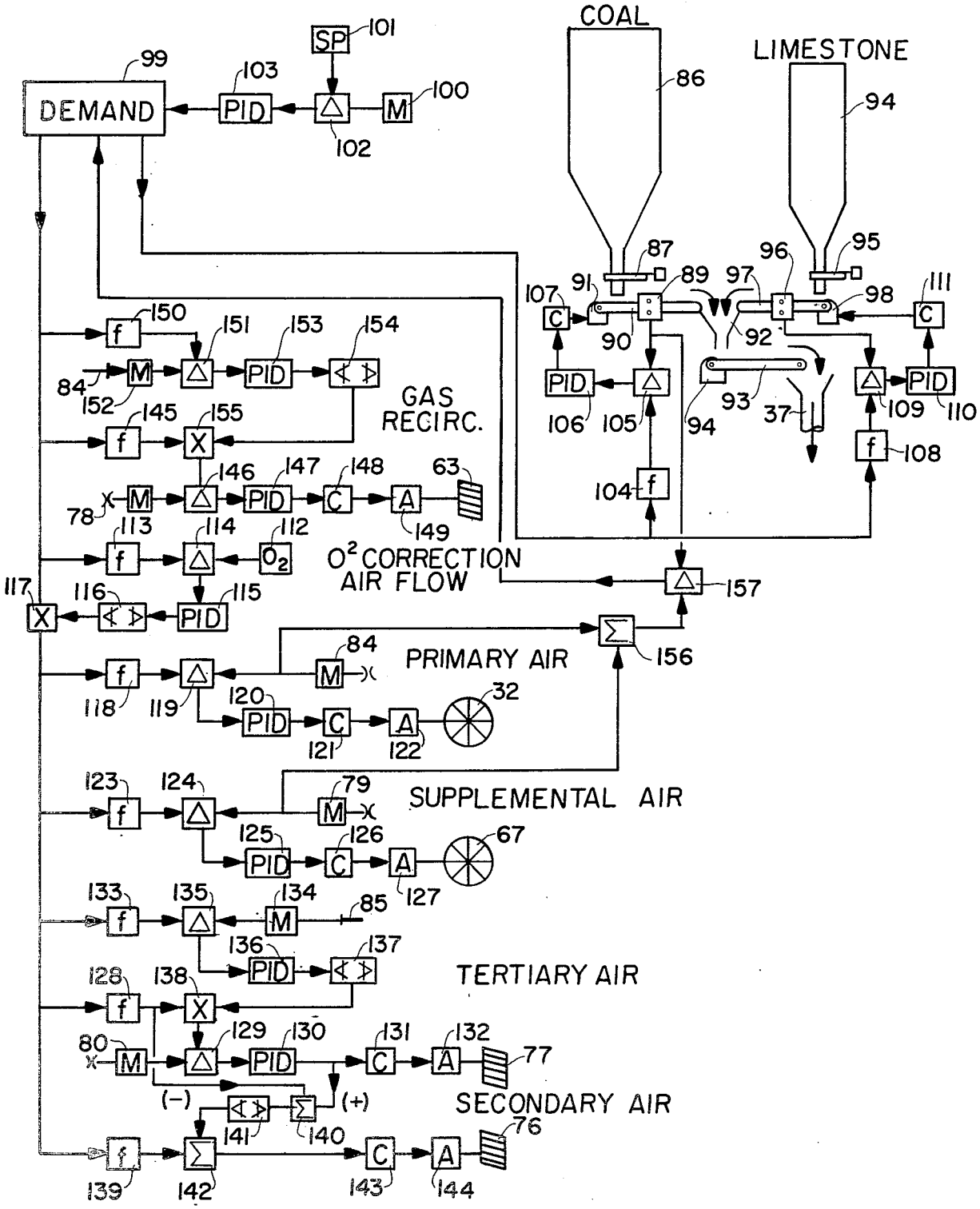
FIG. 2 is an illustration of the proposed combustion control system.

FIG. 2 is a diagram of an appropriate combustion control system in accordance with the principles of this invention.

Coal bunker 86 is equipped with coal gate 87 at the outlet. Coal from bunker 86 flows through gate 87 to feeder 89 which weighs the coal gravimetrically. The feeder 89 is equipped with belt 90 and power drive/leveler 91. The metered flow of coal drops into hopper 92. Hopper 92 feeds coal onto belt 93 driven by power drive 94. Belt 93 discharges into conduit 37 which feeds to combustor 30 through conduit 38.

Limestone bunker 94 is equipped with gate 95 at the outlet. Limestone flows through gate 95 to feeder 96 which weighs limestone volumetrically. The feeder is equipped with belt 97 and power drive/leveler 98. The metered flow of limesstone also drops into hopper 92. The limestone flows along with the coal to combustor 30.

The feeders and belting are encased in a pressure tight enclosure (not shown) from the bunkers to conduit 37 and combustor 30.

Demand controller 99 generates load signals to enable steam generator 1 to satisfy the varying demand of the steam consumer receiving steam from conduit 29. If the demand to the boiler is in error, it is corrected by steam pressure error.

Steam pressure is measured in meter 100 and compared with set point 101 in difference unit 102. The error is corrected in Proportional, Integral, Derivative (PID) controller 103 and sent to demand controller 99.

The demand for coal is sent from 99 to function generator 104. Metered value of coal flow is sent from 89 to difference unit 105 and compared with 104 output value. The error is sent to PID unit 106 for correction. Unit 106 through controller 107 adjusts the feed rate of 89. A similar circuit proportions flow of limestone parallelly with the flow of coal. Units 108, 109, 110 and 111 correspond to units 104, 105, 106 and 107, respectively.

Demand controller 99 generates a demand for air and gas flows for various loadings. The demand for air flow is corrected for actual oxygen in the flue gas as measured by meter 112. This value is compared with the output value of function unit 113 in difference unit 114. The variation or error feeds to PID unit 115 and the correction is high/low limited in 116. The unit 116 output signal ratios the demand signal for air input in unit 117. Thus, the output of 117 is the value which will produce desired excess air in the exhaust gas from the boiler.

The demand for primary air is generated in function unit 118. Primary air metered in venturi 84 is compared with set point in difference unit 119. The error passes through PID unit 120, controller 121 and actuator 122 which positions F.D. fan 31 inlet vanes 32.

Supplemental air flow demand is generated in function unit 123 and compared in unit 124 with actual flow measured in venturi 79. The error is sent to PID unit 125, controller 126 and actuator 127 which positions fan 66 inlet vanes 67.

Supplemental air is distributed between secondary and tertiary ports 39 and 75. As tertiary air damper 77 opens, secondary air damper 76 closes and vice versa. Secondary air is the difference between flow measurement in venturies 79 and 80. In this case secondary air flow control damper position is characterized to load and tertiary air damper 77 position.

Function generator 128 characterizes air damper 77 position vs load. This value is compared in difference unit 129 to actual air flow as measured in venturi 80. The error is sent to PID unit 130, controller 131 and actuator 132 to position damper 77 for flow control.

Function generator 133 establishes set point for furnace 40 exit gas temperature as measured by thermocouple 85 and meter 134. The values are compared in difference unit 135 and the error is sent to PID unit 136. The corrected output is high/low limited in unit 137. The error corrects the demand for tertiary air flow in ratio unit 138. Low temperature increases tertiary air flow and vice versa.

Secondary air flow control damper position is characterized in function unit 139. The output error of unit 130 is fed to the secondary air control circuit through summer 140 which isolates the error. The error is high/-low limited in unit 141. Unit 141 output is summed in 142 with the output of function unit 139. Greater than anticipated opening of damper 77 closes damper 76 some amount and vice versa. The output of summer 142 passes to controller 143 and actuator 144 to position secondary air damper 76.

Gas recirculation at partial loads is needed through ports 39. Function unit 145 characterizes recirculation gas flow. This value is compared in difference unit 146 to actual flow as measured in venturi 78. The error is sent to PID unit 147, controller 148 and actuator 149 to position flow control damper 63.

Gas recirculation also controls gas temperature in the area of secondary ports 39. Function unit 150 characterizes secondary port gas temperature and is compared in difference unit 151 with actual temperature as sensed by thermocouple 84 and meter 152. The error is sent to PID unit 153 and is high/low limited in 154. The correction adjusts gas recirculation demand in ratio unit 155.

Measured primary air flow and supplemental air flow is totallized in summer 156 and compared with total coal flow in difference unit 157 to determine balance of air flow with coal flow. The difference is sent to demand controller 99 so that air and coal flows can be controlled in parallel when one of the two is in a limiting condition.

According to the invention, furnace 40 exit gas temperature is increased above the optimum value for retention of $SO_2$ in the limestone. $SO_2$ is a product of combustion. The reaction for capture of the $SO_2$ is as follows: $CaCO_3$ breaks down to $CaO+CO_2$; $CaO+SO_2+\frac{1}{2}O_2$ combine to form $CaSO_4$ which is a stable product.

On FIG. 1, the gas is cooled as it passes through superheaters 26 and 28 before it enters plenums 43 and 44 for solid particle separation. Fine particles of limestone have a further opportunity for reacting with the $SO_2$ in the gas stream in the optimum temperature range as the gas cools and before particle separation.

Thus, it will be seen that I have provided an efficient embodiment of my invention whereby a staged firing system is provided for a steam generator having a circulating fluidized bed combustion system whereby gas temperature leaving the combustion zone can be elevated, whereby air is admitted to the outlet end of the combustion zone, whereby there is a presence of unburned fuel at the outlet zone to react with the air introduced at this point and whereby mass flow of gas at an intermediate portion of the combustion zone is controlled through the admission of gas recirculated from a point downstream of the combustion zone, the system incorporating means to control gas temperatures independently in the intermediate and end portions of the combustion zone.

While I have illustrated and described several embodiments of my invention, these are by way of illustration only and various changes and modifications may be made within the contemplation of my invention and within the scope of the following claims.

I claim:

1. An apparatus for multi-level temperature control of a circulating fluidized bed in a steam generator which comprises:

means defining a steam generator with combustion system in which the multi-level temperature control of said circulating fluidized bed is carried out;

a feedwater inlet and steam outlet and fluid cooled heat absorption circuits in between;

means for combustion of a solid fuel in a vertical fluid cooled reactor in association with inert solid particles;

first inlet means for air located in the bottom part of said reactor with means for controlling rate of air flow responsive to balancing means for partially combusting and fluidizing said solid fuel and inert particles;

second inlet means for secondary gas located at a level above said first inlet means adapted to entrain a substantial portion of said solid fuel and inert material particles in the flue gas stream produced by said means for combustion;

third inlet means for air located at a level above said second inlet means with means for controlling rate of air flow responsive to said balancing means for regulating continued combustion of particles of said solid fuel;

means for separating particles of solid materials in the flue gas downstream of said reactor;

means for recycling said separated particles as substantially inert material to said means for combustion and for association with said solid fuel;

means for delivery of cooled flue gas after separation of said particles to said second inlet means including a blower or fan with means for controlling rate of gas flow responsive to gas temperature at an intermediate location of said reactor and adapted to increase the recirculation flow to said second inlet means responsive to flue gas temperature at an intermediate location of said reactor increasing the flow to lower gas temperature to a preset point and vice versa;

said balancing means adapted to manipulate the flow of said air to individual portions of said reactor to raise flue gas temperature at said reactor outlet above flue gas temperature at an intermediate portion of said reactor, increasing air flow accelerating combustion and gas temperature rise in the respective reactor zones and vice versa.

2. An apparatus as described in claim 1 and which additionally comprises:

means for delivery of air to said second inlet means with means for controlling rate of air flow responsive to said balancing means and wherein at least a portion of said secondary gas comprises said air.

* * * * *